US006485012B1

(12) United States Patent
Bakoledis

(10) Patent No.: US 6,485,012 B1
(45) Date of Patent: Nov. 26, 2002

(54) ADJUSTABLE INDEXING ROLLER MECHANISM

(75) Inventor: Andrew Bakoledis, Chester, CT (US)

(73) Assignee: GBR Systems Corporation, Chester, CT (US)

( * ) Notice: Subject to any disclaimer, the term of this patent is extended or adjusted under 35 U.S.C. 154(b) by 0 days.

(21) Appl. No.: 09/849,001

(22) Filed: May 7, 2001

(51) Int. Cl.[7] ..... B65H 3/04
(52) U.S. Cl. ..... 271/35; 271/124; 271/125
(58) Field of Search ..... 271/121, 124, 271/125, 35

(56) References Cited

U.S. PATENT DOCUMENTS

| | | | | |
|---|---|---|---|---|
| 798,857 A | | 9/1905 | Zander | |
| 1,682,578 A | | 8/1928 | Nipchild | |
| 1,948,362 A | | 2/1934 | Staude | |
| 2,273,288 A | | 2/1942 | Rouan | |
| 2,339,835 A | | 1/1944 | Burckhardt | |
| 2,635,874 A | * | 4/1953 | La Bore | 271/35 |
| 2,755,086 A | * | 7/1956 | Lubersky | 271/35 |
| 2,887,316 A | | 5/1959 | Tobey | |
| 3,322,602 A | | 5/1967 | Schneider | |
| 3,612,511 A | * | 10/1971 | Godlewski | 271/35 |
| 3,664,660 A | | 5/1972 | Runzi | |
| 3,831,928 A | | 8/1974 | Davis | |
| 3,908,983 A | | 9/1975 | Long | |
| 3,933,350 A | | 1/1976 | Mignano | |
| 4,128,236 A | | 12/1978 | Lundblad | |
| 4,529,187 A | | 7/1985 | Einem | |
| 4,603,848 A | | 8/1986 | Markgraf | |
| 4,607,832 A | | 8/1986 | Abe | |
| 4,715,593 A | * | 12/1987 | Godlewski | 271/35 |
| 4,720,960 A | | 1/1988 | Green | |
| 4,858,907 A | | 8/1989 | Eisner | |
| 4,991,831 A | | 2/1991 | Green | |
| 5,143,365 A | | 9/1992 | Green | |
| 5,195,737 A | * | 3/1993 | Ifkovits et al. | 271/35 |
| 5,244,197 A | * | 9/1993 | Helmstadter | 271/35 |
| 5,244,198 A | | 9/1993 | Green | |
| 5,642,877 A | | 7/1997 | Green | |
| 5,772,199 A | * | 6/1998 | Green | 271/35 |

FOREIGN PATENT DOCUMENTS

| | | | | |
|---|---|---|---|---|
| JP | 62-36246 A | * | 2/1987 | 271/125 |
| JP | 62-259933 A | * | 11/1987 | 271/35 |

* cited by examiner

*Primary Examiner*—H. Grant Skaggs
(74) *Attorney, Agent, or Firm*—Joseph J. Previto

(57) ABSTRACT

A sheet feeding mechanism including a singulating assembly and mechanism for accumulating sheets in a stack adjacent the singulating assembly. The singulating assembly comprises a retard roller and a guard adjacent thereto. The retard roller has a first bearing surface at a lower position. A mechanism is provided for feeding single sheets from the stack past the bearing surface of the retard roller and beneath it. The retard roller is adjustable to move the first bearing surface away from its lower position and replacing it with a second bearing surface at the lower position.

15 Claims, 4 Drawing Sheets

ADJUSTABLE INDEXING ROLLER MECHANISM

BACKGROUND

The present invention relates to sheet feeding mechanisms and more particularly to an adjustable indexing roller assembly for sheet feeding mechanisms.

In current sheet feeding mechanisms, printed paper sheets are fed from one machine to another or from one portion of a machine to another portion of the machine. In such sheet feeding mechanisms, sheets are accumulated in a stack and then fed one by one from the bottom of the stack to another portion of the machine so that other functions may be performed on the sheets. It is important that the sheets be fed one-by-one so that the mechanism for feeding the sheets one-by-one from a stack must be accurately positioned to feed a single sheet only. In existing machines the mechanism for controlling the feeding of the sheets are complex and difficult to adjust accurately. In addition, the sheets are moved at high speed from the bottom of the stack so that there is danger of smudging the printed sheets.

OBJECTS

The present invention avoids these problems and has for one of its objects the provision of an improved adjustable indexing roller assembly which can be easily adjusted to control the feeding of a single sheet from the bottom of a stack.

Another object of the present invention is the provision of an improved adjustable indexing roller assembly the height of which can be easily adjusted to accommodate different thicknesses of paper being fed.

Another object of the present invention is the provision of an improved indexing roller assembly in which a worn bearing surface on the indexing roller may be easily replaced with a new bearing surface without dismantling the indexing roller assembly.

Another object of the present invention is the provision of an improved indexing roller assembly which is simple to operate.

Another object of the present invention is the provision of an improved indexing roller assembly which is inexpensive to manufacture and maintain.

Another object of the present invention is the provision of an improved indexing roller assembly in which the possibility of smudging the printed sheets as they are being fed is minimized or eliminated.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
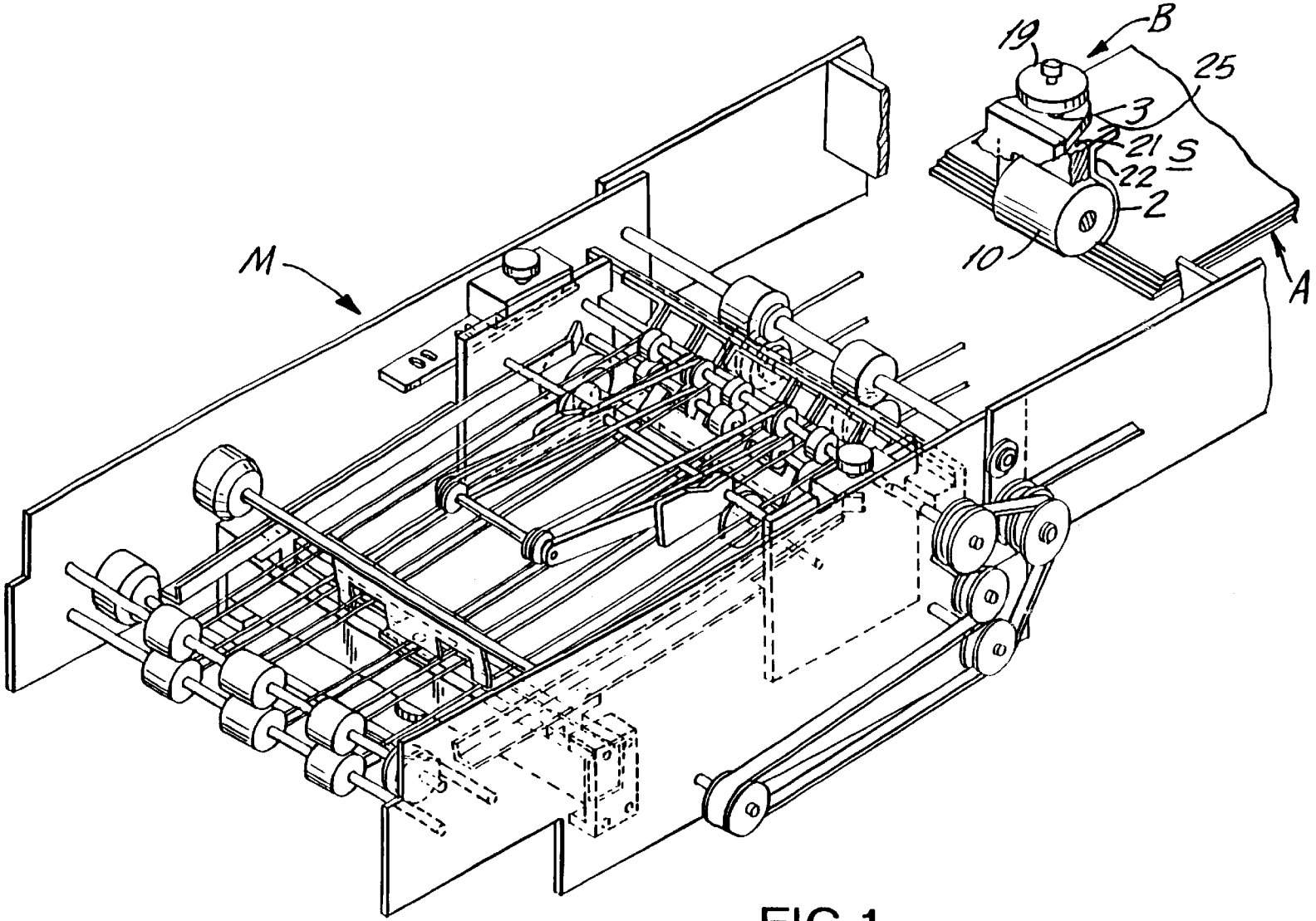
FIG. 1 is a perspective view of the machine in which the present invention is to be used.
Figure 2:
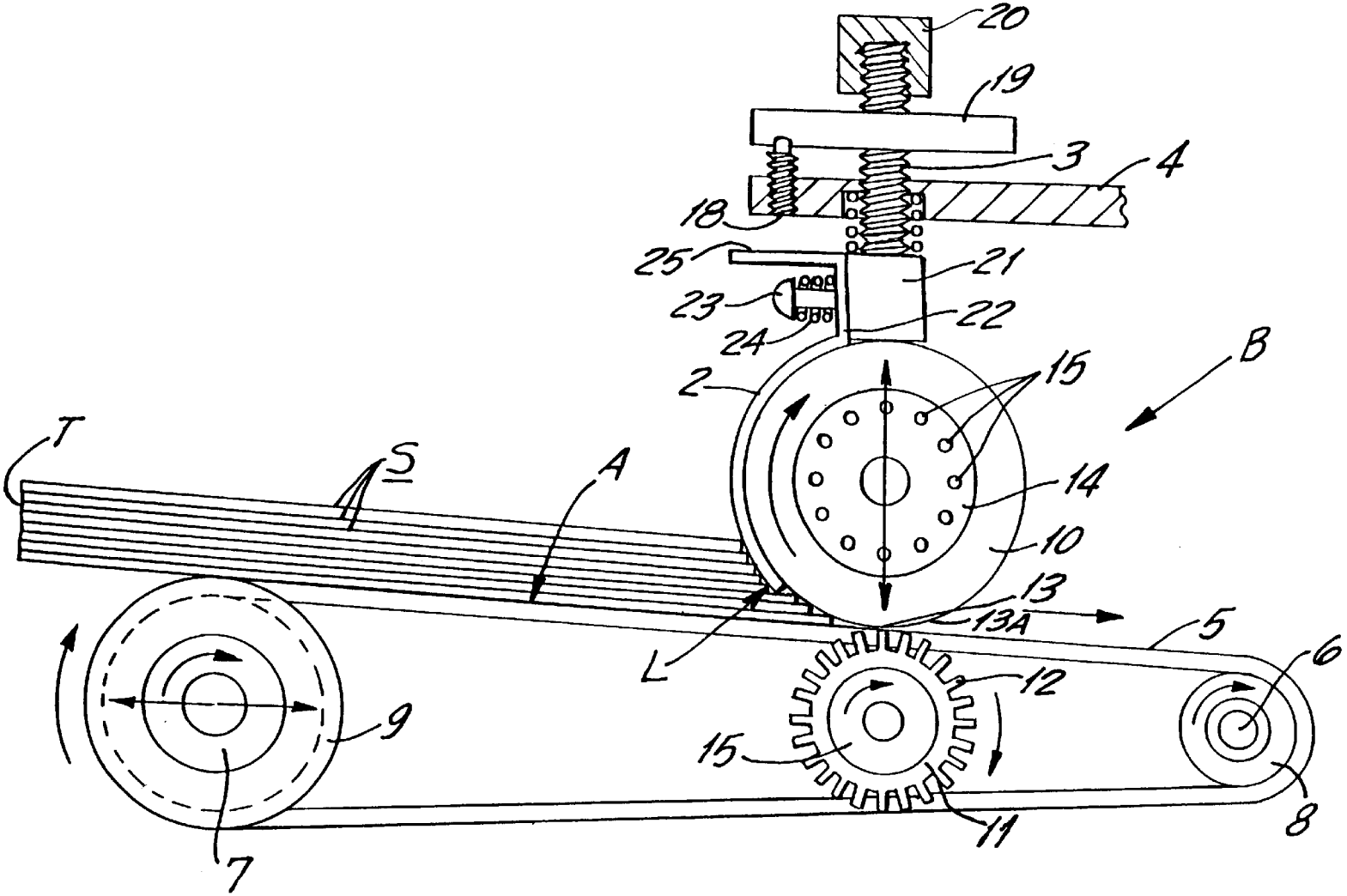
FIG. 2 is a schematic side elevational view showing the present invention.
Figure 3:
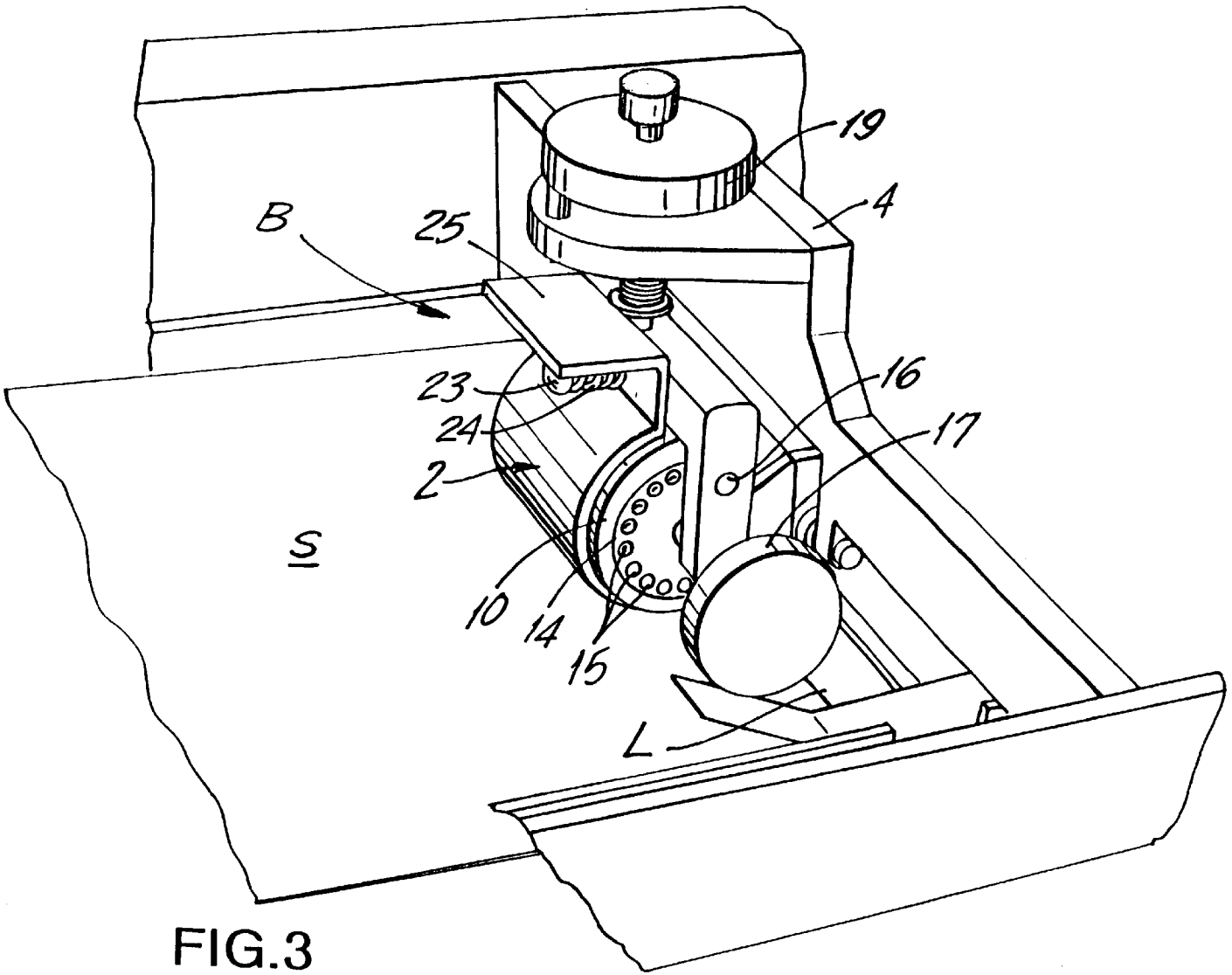
FIG. 3 is a schematic perspective view showing the present invention.

Sheets S are fed one-by-one to an accumulating area A shown schematically in FIG. 1. The sheets S accumulate against a sheet singulating assembly B which feeds the sheets S one-by-one to other mechanisms (not described for clarity) in the machine M for further processing. The sheet singulating assembly B is shown in FIG. 2 and comprises curved guide brake 2 and a retard roller 10. A plurality of side-by-side feed belts 5 and a singulator roller 11 are located beneath the sheet singulating assembly B. The sheets S accumulate in a stack on the accumulating area A on the feed belts 5. The feed belts 5 are driven by one way clutch rollers 6 and 7 having idler rollers 8 and 9 around which the feed belts 5 are wound. The feed belts 5 move forward in stop-and-go indexing fashion making one complete cycle at a time and feed a single sheet S for each cycle from the bottom of the stack S.

The sheet singulating assembly B with the curved stationary guide brake 2 as well as the stationary indexing retard roller 10, depend from a threaded member threadedly mounted on a frame 4 to permit the entire sheet singulating assembly B to be raised and lowered. The retard roller 10 is mounted on a stationary support 21. The indexing retard roller 10 is mounted on the support 21 by means of an upstanding flange 22 which is spring tensioned against the support 21 by screw 22 and spring 24. A handle 25 extends from the flange 22. An adjustment wheel 19 on the threaded member 3 is provided so that the height of the singulating assembly B can be moved up or down to accommodate the thickness of the paper sheet S being fed. A stop nut 20 is provided on threaded member 3 to limit the lowering of the indexing retard roller 10 at a predetermined level. The sheets S stack up against the curved guide brake 2 with the leading edges L conforming to the curve of the guide brake 2. The retard roller 10 is mounted adjacent to and in front of the guide brake 2 so that as the sheets S are being fed, they are moved beneath the lower bearing surface 13 of indexing retard roller 10 by the belts 5.

The rotatable singulator roller 11 is controlled by a one way clutch 15 and lies directly beneath the indexing retard roller 10. The singulator roller 11 has soft resilient splines 12 extending therefrom which will help to move the sheets S beneath the bearing surface 13 of the indexing retard roller 10. One cycle of the belts 5 will move a single sheet S between the bearing surface 13 of the indexing retard roller 10 and the splines 12 of the singulator roller 11 until the leading edge L of the sheet S is grasped by high speed take-away pinch rollers (not shown). At this point the belts 5 have stopped moving at the end of a cycle so that the trailing edge T of each sheet S is pulled through between the lower surface 13 of the retard roller 10 and splines 12 of singulator roller 11 by take-away pinch rollers (not shown). By allowing the belts 5 to move at the speed of the take away pinch rollers, smudging of printing on the sheets S is minimized or eliminated. Since the splines 12 are resilient, the pressure between the splines 12 and lower surface 13 of retard roller 10 is small and the two will make very little contact with the sheets S so as to further prevent smudging of the printing on the sheets S.

As the sheets S are moved beneath the lower surface 13 of the retard roller 10, the lower surface 13 of the indexing roller 10 under which the sheets S pass may start to wear so that space between surface 13, belts 5 and splines 12 may widen. If this occurs the indexing retard roller 10 may not be able to limit a single sheet S to pass underneath. To remedy this, the indexing retard roller 10 is rotated so that the worn bearing surface 13 is moved out of the way from its lowermost position opposite splines 12 and another bearing surface 13A is placed at the lowermost position opposite splines 12. This may be accomplished by rotating a dial 14 which is connected to the retard roller 10. The dial 14 is rotatably mounted on the support 21, has a plurality of indentations 15 and may be rotated by a wheel 17 mounted on support 21. A detent 16 is mounted on the support 21 adjacent the dial 14 and is spring pressed to enter one of the indentations 15 to keep the retard roller 10 in place after it has been rotated to present the next bearing surface 13A to the lowermost position. This places a new bearing surface 13 A opposite splines 12 and between which the sheets S move without the necessity of readjusting the height of the entire singulating assembly B.

Figure 4:
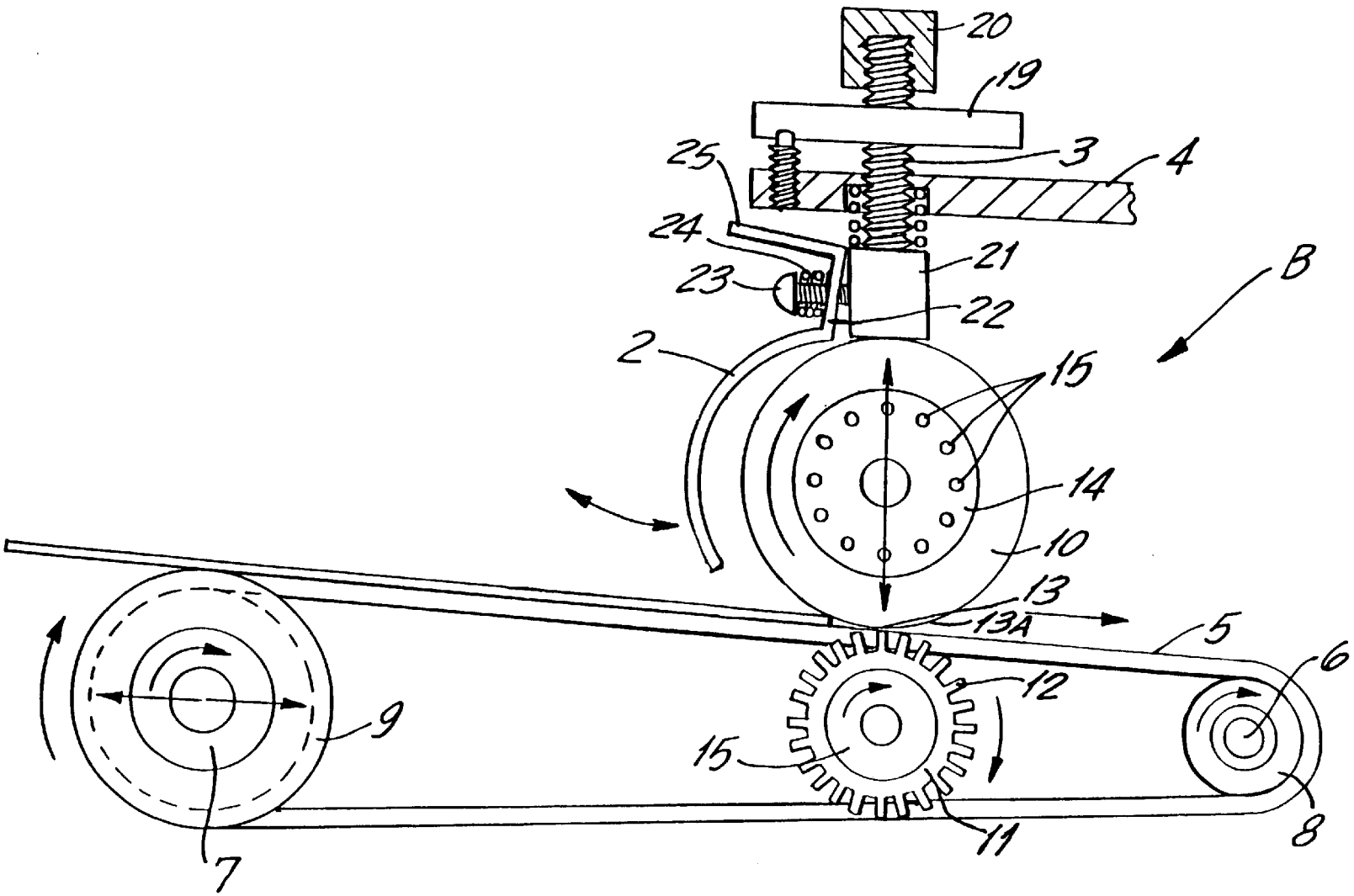
FIG. 4 is a schematic side elevational view showing the manner of adjusting the mechanism of the present invention.

In operation, the singulating assembly B comprising paper guide 2 and the indexing retard roller 10 is adjusted to the desired height by the threaded member 3 controlled by wheel 19. A spring pressed detent 18 keeps the wheel 19 in the desired position. The sheets S will be moved one-by-one by the belts 5 between the bearing surface 13 of the retard roller 10 and the rotatable flexible splines 12 of the singulator roller 11. The belts 5 move one cycle at a time to feed a single sheet S at a time. The guide brake 2 is spaced above the belts 5 so as to allow the leading edges of several sheets of paper to contact the retard roller 10 and to insure that only a single sheet S is fed at a time. If the bearing surface 13 under which the sheets move wears, the spacing between bearing surface 13, belt 5 and splines 12 will increase so that a sheet between the retard roller 10 and the splines 12 will be moved forward. In order to readjust the mechanism to the proper spacing without adjusting the height of the entire singulating assembly B, all the sheets that are stacked on the belts A are removed except the sheet that is between the retard roller 10 and the splines 12. The guide brake 2 is released from retard roller 10 by lifting the handle 25 (FIG. 4) to move the guide brake 2 away from retard roller 10. The wheel 17 is turned to rotate the retard roller 10 until the detent 16 enters into the next indentation on dial 14 so that a new bearing surface 13A is moved to its lowermost position opposite splines 12. Since adjustment of the height of the entire singulating assembly B is not necessary, the spacing of the indexing roller 10 to the belts 5 the sheets S and the splines 12 of singulating roller 11 remains the same and the machine will continue to feed single sheets S with no danger of smudging or double sheet feeding.

It will thus be seen that the present invention provides an improved adjustable indexing roller assembly which can be easily adjusted to control the feeding of a single sheet from the bottom of a stack, in which the height can be easily adjusted to accommodate different thicknesses of paper being fed, in which a worn bearing surface on the indexing roller may be easily replaced with a new bearing surface without dismantling it, and which is simple to operate, inexpensive to manufacture and maintain and in which the possibility of smudging the printed sheets as they are being fed is minimized or eliminated.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A sheet feeding mechanism comprising a singulating assembly, means for accumulating sheets in a stack adjacent the singulating assembly, said singulating assembly comprising a retard roller, said retard roller having a first bearing surface at a lower position, means for feeding single sheets from the stack past and beneath the bearing surface of the retard roller, said retard roller being adjustable to move the said first bearing surface away from its lower position and replacing it with a second bearing surface at said lower position, a singulating roller mounted beneath the said bearing surface of said retard roller, said sheet feeding means move said sheets between said bearing surfaces and said singulating roller, said sheets being fed from the bottom of said stack, said sheet feeding means comprises at least one belt on which said sheets are stacked, said singulating assembly comprises a guard mounted and spaced in front of said retard roller, said sheets being adapted to be stacked against said guard and above said belt, means for moving said guide brake toward and away from said retard roller.

2. A feeding mechanism as set forth in claim 1 wherein height adjusting means are provided to adjust the height adjusting the singulating assembly relative to said belts and singulating roller.

3. A feeding mechanism as set forth in claim 2 wherein said singulating roller comprises a plurality of splines extended therefrom.

4. A feeding mechanism as set forth in claim 3 wherein said splines are resilient.

5. A sheet feeding mechanism as set forth in claim 4 wherein means are provided for holding the retard roller in a predetermined position with its bearing surface in its lower position opposite the singulating roller.

6. A feeding mechanism as set forth in claim 5 wherein said guard is located above the belt.

7. A sheet feeding mechanism as set forth in claim 2 in which a pair of belts are provided and wherein the belts are moved one cycle at a time to move a single sheet at a time from the stack to between the bearing surface of the retard roller and the splines of the singulating roller.

8. A sheet feeding mechanism as set forth in claim 7 wherein said belts are moved by rollers which are controlled by one way clutches.

9. A sheet feeding mechanism as set forth in claim 8 wherein said singulating roller is controlled by a one way clutch.

10. A sheet feeding mechanism as set forth in claim 9 wherein said height adjusting means comprises a threaded member from which said singulating assembly depends.

11. A sheet feeding mechanism comprising a singulating assembly means for accumulating sheets in a stack adjacent the singulating assembly, said singulating assembly comprising a retard roller, said retard roller having a first bearing surface at a lower position, means for feeding single sheets from the stack past and beneath the bearing surface of the retard roller, said retard roller being adjustable to move the said first bearing surface away from its lower position and replacing it with a second bearing surface at said lower position, a singulating roller is mounted beneath the said bearing surface of said retard roller, said sheet feeding means adapted to move said sheets between said bearing surface and said singulating roller, said sheets being fed from the bottom of the stack, said sheet feeding means comprises at least one belt on which said sheets are stacked, said singulating assembly comprises a guide brake in front of said retard roller, said sheets being stacked against said guide brake height adjusting means are provided to adjust the height of the singulating assembly relative to said belt and singulating roller, said singulating roller comprises a plurality of resilient splines extended therefrom means for holding the retard roller in a predetermined position with its bearing surface in its lower position opposite the singulating roller, said guide brake is located above the belt, an adjustment dial is mounted adjacent the roller, said dial being rotated in order to rotate the roller to present said second bearing surface to its lower position opposite said singulating roller.

12. A sheet feeding mechanism as set forth in claim 11 in which a pair of belts are provided and wherein the belts are moved one cycle at a time to move a single sheet at a time from the stack to between the bearing surface of the retard roller and the splines of the singulating roller.

13. A sheet feeding mechanism as set forth in claim 12 wherein said belts are moved by rollers which are controlled by one way clutches.

14. A sheet feeding mechanism as set forth in claim 13 wherein said singulating roller is controlled by a one way clutch.

15. A sheet feeding mechanism as set forth in claim 14 wherein said height adjusting means comprises a threaded member from which said singulating assembly depends.

* * * * *